United States Patent [19]

Rex

[11] 4,376,587

[45] Mar. 15, 1983

[54] PRINT RIBBON PROTECTION

[75] Inventor: Donald K. Rex, Highland Beach, Fla.

[73] Assignee: International Business Machines Corporation, Armonk, N.Y.

[21] Appl. No.: 289,584

[22] Filed: Aug. 3, 1981

[51] Int. Cl.[3] ..... B41J 35/36

[52] U.S. Cl. ..... 400/247; 400/231

[58] Field of Search ..... 400/249, 231, 247, 248.3, 400/194

[56] References Cited

U.S. PATENT DOCUMENTS 3,949,856 4/1976 Ulber et al. ..... 197/133 R
4,268,182 5/1981 Mizutani et al. ..... 400/249 X

FOREIGN PATENT DOCUMENTS 2512259 9/1976 Fed. Rep. of Germany ..... 400/249
2646336 4/1978 Fed. Rep. of Germany ..... 400/249
1499152 1/1978 United Kingdom ..... 400/249

OTHER PUBLICATIONS

IBM Technical Disclosure Bulletin, vol. 24, No. 10, Mar. 1982, pp. 5015-5016.

*Primary Examiner*—William Pieprz
*Attorney, Agent, or Firm*—Walter J. Madden, Jr.

[57] ABSTRACT

In a printing system employing a spliced endless print ribbon, an opening is provided in the ribbon adjacent the splice to enable sensing of the approach of the splice to the print station. Printing is suspended as the splice passes the print station to avoid undesirable printing quality and damage to the splice. The same sensing means detects lack of ribbon movement, indicative of a ribbon jam, to suspend printing and ribbon drive.

4 Claims, 4 Drawing Figures

PRINT RIBBON PROTECTION

BACKGROUND OF THE INVENTION

1. Field of the Invention

This invention relates to ribbons for printers and relates more particularly to a system to give such ribbons improved life and print quality.

2. Description of the Prior Art

In some printing systems, it is desirable to employ an endless ribbon and a stuffer box to provide a low cost ribbon system. The stuffer box is used to store the excess ribbon in the ribbon loop, this excess being fed or "stuffed" into the box. There are three major problems which may arise from the use of such an endless ribbon. First, when the nylon ribbon is spliced, the narrow splice area of the ribbon does not readily accept ink so that this area is unsuitable for printing. Secondly, the ribbon splice area is less able to withstand print forces than the rest of the ribbon, thereby resulting in a high likelihood of ribbon failure at the splice area if printing is attempted on this area. Thirdly, if the ribbon jams in the stuffing box area, or elsewhere in the ribbon path, the ribbon ceases to be fed past the print mechanism and will be destroyed by the action of the print mechanism. Therefore, it is desirable in such printing systems to provide indications of the approach of the ribbon splice to the print station and of lack of ribbon motion indicating a ribbon jam.

Prior Art

U.S. Pat. No. 3,949,856 shows the use of a roller mechanism to detect medium movement to indicate medium jams. However, this reference does not show the detection of ribbon splice and ribbon jam.

SUMMARY OF THE INVENTION

The present invention employs sensing means which engages the moving ribbon and senses a characteristic thereof in the vicinity of the splice, such as an opening in the ribbon near the splice. Sensing of this characteristic is employed to suspend printing while the splice area passes through the print station. As an additional feature of the invention, the duration of time during which the characteristic is sensed is used to determine whether a splice is approaching the print station or whether this duration indicates that the ribbon motion has stopped as a result of a ribbon jam.

DESCRIPTION OF THE BEST EMBODIMENT

Figure 1:
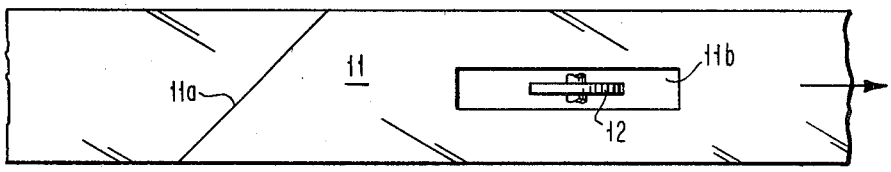
FIG. 1 is a plan view of a section of an endless printing ribbon showing the splice area.

In FIG. 1, a portion of an endless ribbon 11 is shown, with a splice therein as indicated at 11*a* joining the ends. It will be understood that ribbon 11 is transported past a print station containing one or more print mechanisms which contact ribbon 11 to produce print characters on a suitable medium. It is in the area of this splice that printing is to be avoided because of poor inking properties and the potential for damage to the splice by the print mechanism, as discussed above. To provide this feature and to also provide an indication of ribbon jam, the present invention provides an opening 11*b* in ribbon 11 spaced slightly from splice 11*a*. Opening 11*b* may be either ahead of or behind splice 11*a* in the direction of ribbon motion, depending on the position of the sensing means relative to the print station. The presence or absence of this opening at a predetermined point in the ribbon travel path can be sensed to suspend printing while splice 11*a* and opening 11*b* pass the print station. The same sensing means can be employed to detect lack of ribbon motion indicative of a ribbon jam, or to stop the printer.

Figure 2:
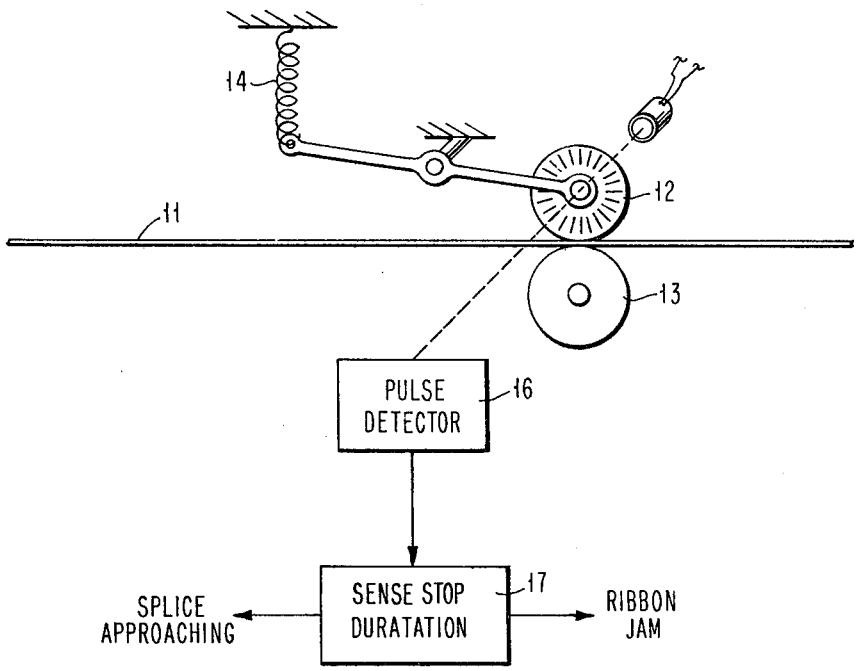
FIG. 2 is a side view showing optical sensing means positioned adjacent the endless ribbon section.

The presence or absence of opening 11*b* can be sensed by any suitable means. For example, as best seen in FIG. 2, a sensing wheel 12 may be employed to ride on ribbon 11. Wheel 12 may be urged against ribbon 11 and an underlying idler wheel 13 by a spring means 14 so that wheel 12 rotates with movement of ribbon 11. Sensing wheel 12 may be of any suitable type capable of producing some type of output signal in response to its rotation and to provide a different or no output signal when it is not rotating. Examples of suitable types of such wheels are optical disks having slits therein for the passage of light therethrough to produce a train of detectable light pulses as the wheel rotates, as shown in FIG. 2 and as is well known in the art. Alternatively, the wheel may produce magnetic pulses during rotation which can be converted to signals denoting motion of the wheel and hence of ribbon 11, as shown in FIG. 4.

In FIG. 2, the light pulses passing through the slits in wheel 12 as it rotates are sensed by a light pulse detector 16 which produces an output signal indicating that ribbon motion has been detected. These signals from detector 16 are supplied to circuitry 17 which measures any gaps or missing pulses in the output from detector 12. As indicated in the flow chart of FIG. 3, as long as the pulses from detector 12 appear at regular intervals, indicating that wheel 12 is rotating and ribbon 11 is moving, circuitry 17 operates normally. If the pulses from detector 12 stop, circuitry 17 senses the duration of this cessation of pulses, and if the cessation period corresponds to the predetermined length of time required for opening 11*b* in ribbon 11 to pass under sensing wheel 12, circuitry 17 indicates to the printer controls that the ribbon splice is approaching the print station so that printing will be suspended while opening 11*b* and splice 11*a* pass the print station.

If the pulse cessation period exceeds the predetermined length of time required for opening 11*b* to pass under wheel 12, indicating that ribbon motion has stopped because of a ribbon jam or other malfunction, circuitry 17 indicates this condition to cause printing and ribbon drive to be halted and an error condition indicator to be raised.

Figure 4:
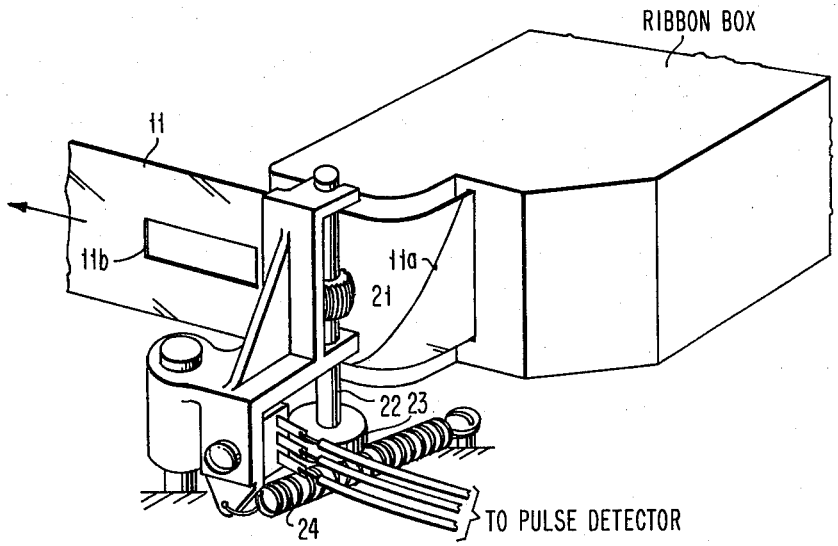
FIG. 4 is a schematic diagram showing the use of magnetic sensing means.

FIG. 4 illustrates an alternate embodiment of the invention employing magnetic sensing to detect ribbon motion and opening 11*b* in ribbon 11. As before, ribbon 11 includes a splice 11*a* on which it is undesirable to print. Ribbon motion is sensed by means including a knurled magnet drive wheel 21 which is rotatably mounted on a shift 22. Drive wheel 21 engages ribbon 11 and rotates on shaft 22 as the ribbon moves. The lower end of shaft 22 carries a magnet 23 which rotates with shaft 22 and cooperates magnetically with a detector 24, such as a Hall effect detector, which produces an output signal indicative of rotation of magnet 23 and hence of motion of ribbon 11.

Figure 3:
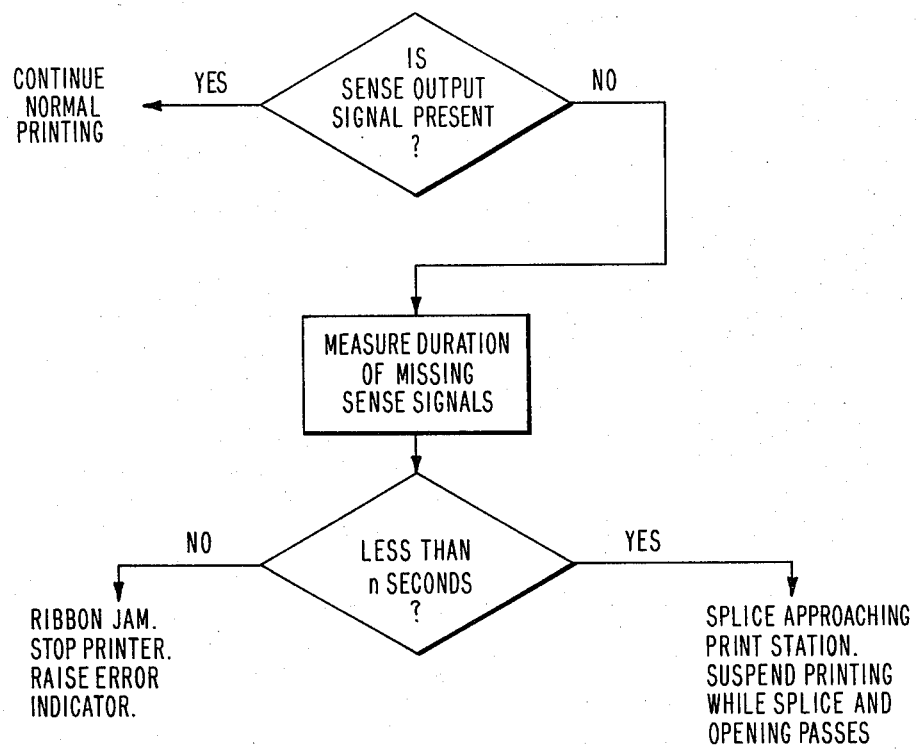
FIG. 3 is a flow chart illustrating the operation of the present invention to detect both the approach of the ribbon splice and a ribbon jam.

As in the embodiment of FIGS. 1 and 2, and as shown in the flow chart of FIG. 3, the output from detector 24 is supplied to circuitry which is operable to determine if a gap appears in the detector output and if this gap exceeds a predetermined length of time. When the predetermined length gap is detected, corresponding to opening 11*b* passing drive wheel 21, printing is suspended while splice 11*a* and opening 11*b* pass the print station. If the gap in the detector signal exceeds the predetermined length, indicating that the ribbon motion has stopped because of a jam, print head motion drive and ribbon motion drive are stopped until the problem is corrected.

Hence the present invention provides a simple technique for detecting both the ribbon splice and a ribbon jam, to extend the life of the ribbon and to add to the quality and reliability of the printing system.

I claim:

1. In an impact printer for printing markings on a record medium, said printer including a ribbon which is driven past a print station between said medium and a print head member, said member being controlled to impact against said ribbon to thereby leave a marking on said medium, said ribbon being an endless loop having a splice therein, the improvement comprising:

means for detecting a single characteristic of said ribbon indicative of ribbon motion, said ribbon having an area adjacent to said splice which does not provide said characteristic indicative of said ribbon motion for a predetermined length of time, means for determining the absence of said characteristic for said predetermined length of time or less to suspend printing while said splice passes said print station, and means responsive to the absence of said detected characteristic for longer than said predetermined length of time, indicative of lack of ribbon motion, for suspending printing and for stopping ribbon drive.

2. Apparatus in accordance with claim 1, including an elongated opening in said ribbon positioned near said splice; and drive means positioned adjacent to said ribbon and aligned therewith to intersect said opening; said drive means being rotated by the movement of said ribbon except when said drive means intersects said opening or when said ribbon movement stops.

3. Apparatus in accordance with claim 2, in which said drive means includes an optical disk which is rotated by movement of said ribbon to produce optical signals indicative of said movement.

4. Apparatus in accordance with claim 2, in which said drive means includes magnetic means rotated by movement of said ribbon to produce magnetic signals indicative of said movement.

* * * * *